US011077577B2

(12) United States Patent
Nabity et al.

(10) Patent No.: US 11,077,577 B2
(45) Date of Patent: Aug. 3, 2021

(54) SYSTEM, METHOD AND APPARATUS FOR PRODUCING A QUILT BLOCK ON A SINGLE DIE

(71) Applicant: Tek Industries, Inc., Omaha, NE (US)

(72) Inventors: Stephen W. Nabity, Omaha, NE (US); Lynn Gibney, Morse Bluff, NE (US)

(73) Assignee: Tek Industries, Inc., Omaha, NE (US)

( * ) Notice: Subject to any disclaimer, the term of this patent is extended or adjusted under 35 U.S.C. 154(b) by 0 days.

(21) Appl. No.: 16/516,912

(22) Filed: Jul. 19, 2019

(65) Prior Publication Data

US 2020/0039103 A1 Feb. 6, 2020

Related U.S. Application Data

(60) Provisional application No. 62/713,738, filed on Aug. 2, 2018.

(51) Int. Cl.

| | |
|---|---|
| ***B26F 1/44*** | (2006.01) |
| ***D05B 37/04*** | (2006.01) |
| *B26F 1/42* | (2006.01) |

(52) U.S. Cl.

CPC ..... *B26F 1/44* (2013.01); *D05B 37/04* (2013.01); *B26F 1/42* (2013.01);

(Continued)

(58) Field of Classification Search

CPC ... D05B 37/04; B26F 1/44; B26F 1/42; B26F 2001/4436; B26F 2001/4472; B26F 2001/4481; B26F 2001/4463; Y10T 83/9449; Y10T 83/0333; Y10T 83/9425; Y10T 83/9476; Y10T 403/7022; Y10T 83/9461; Y10T 83/9411; Y10T 83/9473

(Continued)

(56) References Cited

U.S. PATENT DOCUMENTS 2,860,555 A * 11/1958 Williamson ..... B26F 1/44 493/476
3,269,280 A * 8/1966 Bonwit ..... B26F 1/44 493/473

(Continued)

OTHER PUBLICATIONS

Printout of YouTube Video of May 29, 2015.†

(Continued)

*Primary Examiner* — Ghassem Alie
(74) *Attorney, Agent, or Firm* — Milligan PC LLO

(57) ABSTRACT

The present invention provides a system, method and apparatus for producing a quilt block on a single die. According to a preferred embodiment, the die cut assembly of the present invention preferably includes a cutting rule formed into a pattern including a group of geometric cutting elements. According to a further preferred embodiment, the group of geometric cutting elements preferably includes a first set of cutting element including a first pentagon shape, a second pentagon shape, and a first quadrilateral shape which are connected by shared edges. According to a further preferred embodiment, the group of geometric cutting elements of the present invention preferably further includes a second set of cutting elements which includes a third pentagon shape, a fourth pentagon shape and a second quadrilateral shape, which are a mirrored copy of the first set of cutting elements.

7 Claims, 7 Drawing Sheets

(52) U.S. Cl.
CPC ..... *B26F 2001/4436* (2013.01); *B26F 2001/4472* (2013.01); *B26F 2001/4481* (2013.01)

(58) Field of Classification Search
USPC ..... 83/566, 685, 679, 686, 695, 698.11, 83/698.31, 698.71, 698.91, 6, 98, 651; 76/107.8, 107.1
See application file for complete search history.

(56) References Cited

U.S. PATENT DOCUMENTS

| | | | | | |
|---|---|---|---|---|---|
| 3,847,036 | A * | 11/1974 | Miller | B23P 15/406 | 76/107.8 |
| 4,607,553 | A * | 8/1986 | Hartzell | B26D 7/18 | 83/164 |
| 5,211,084 | A * | 5/1993 | Holliday | B26F 1/44 | 219/121.67 |
| 5,943,935 | A * | 8/1999 | Brayton | B26F 1/44 | 493/354 |
| 2012/0272802 | A1 * | 11/2012 | Nabity | B26F 1/44 | 83/55 |

OTHER PUBLICATIONS

Blessington New Release of May 21, 2015.†
Amazon Screen Print relating to public release of Die Cutter on Jun. 1, 2015.†

* cited by examiner
† cited by third party

SYSTEM, METHOD AND APPARATUS FOR PRODUCING A QUILT BLOCK ON A SINGLE DIE

CROSS-REFERENCE TO RELATED APPLICATIONS

The present application claims priority to U.S. Provisional Application No. 62/713,738 filed Aug. 2, 2018.

BACKGROUND AND FIELD OF THE PRESENT INVENTION

Field of the Present Invention

The present invention relates to die cutting and, in particular, to a system, method and apparatus for producing a quilt block on a single die.

Background of the Invention

Die cutting is an established form of quickly and accurately cutting shapes from sheet materials. Die cutting has been used extensively in industrial applications to cut boxes, cartons, shoe soles, clothing and many other components of manufactured items. These large industrial dies are usually utilized with large hydraulic presses or mechanized rollers. The dies are often multiple feet in dimension, of medium to heavy weight and have exposed cutting edges. These industrial dies are used almost exclusively in a controlled industrial environment and handled and maintained by trained personnel. Mass production necessarily limits the variety of shapes, sizes and materials produced by industrial die cutting machines.

Many smaller die cutting machines have been developed so that crafts-people can create shapes and patterns as desired in a more economical manner. One example of such a die cutting machine is described in U.S. Pat. No. 5,647,260. These die cutting machines, which are often used in schools, businesses and homes, are currently available in the market place. Most of these smaller die cutting machines are roller-type machines which use rollers to provide the compression necessary to force the die to cut the sheet material into the geometric cut-out shapes.

At present, the main drawback to current die cutting machines is that they are limited to producing smaller patterns. When creating a larger pattern (such as for a quilt), multiple dies must be used. Further, the multiple dies must be carefully arranged, tracked and positioned to get the correct assortment of cut pieces. Once cut, these pieces must then be further tracked; positioned and arranged so that they can be correctly sewn together.

These prior art systems and methods require extensive organizational skills and multiple steps to create a quality end product. Accordingly, a need exists to provide a system, method and apparatus for use in connection with die cutting machines which allows a complete quilt pattern to be created from a single die.

SUMMARY OF THE INVENTION

The present invention is generally directed to a die cut assembly for a roller die cutting machine having a base member, a cutting rule, and a compressible top layer. The base member is generally rectangular, having a length, width and thickness. A cutting rule or blade including a cutting edge is formed into a pattern containing a plurality of geometric shapes. The cutting rule is generally joined to the base member in a skewed or angled orientation whereby no side or edge of the pattern is transverse to the length of the base member. The compressible top layer is coupled to the base member.

According to a preferred embodiment, the die cut assembly of the present invention preferably includes a cutting rule formed into a pattern including a group of geometric cutting elements. According to a further preferred embodiment; the group of geometric cutting elements preferably includes a first set of cutting element including: a first pentagon shape; a second pentagon shape; and a first quadrilateral shape.

According to a further preferred embodiment, the group of geometric cutting elements of the present invention preferably further includes a second set of cutting elements which includes: a third pentagon shape; a fourth pentagon shape; and a second quadrilateral shape.

The accompanying drawings, which are incorporated in and constitute part of the specification, illustrate various embodiments of the present invention and together with the description, explain the principles of the present invention. Other and further objects of the invention, together with the features of novelty appurtenant thereto, will appear in the course of the following description.

DETAILED DESCRIPTION OF THE INVENTION

Figure 1:
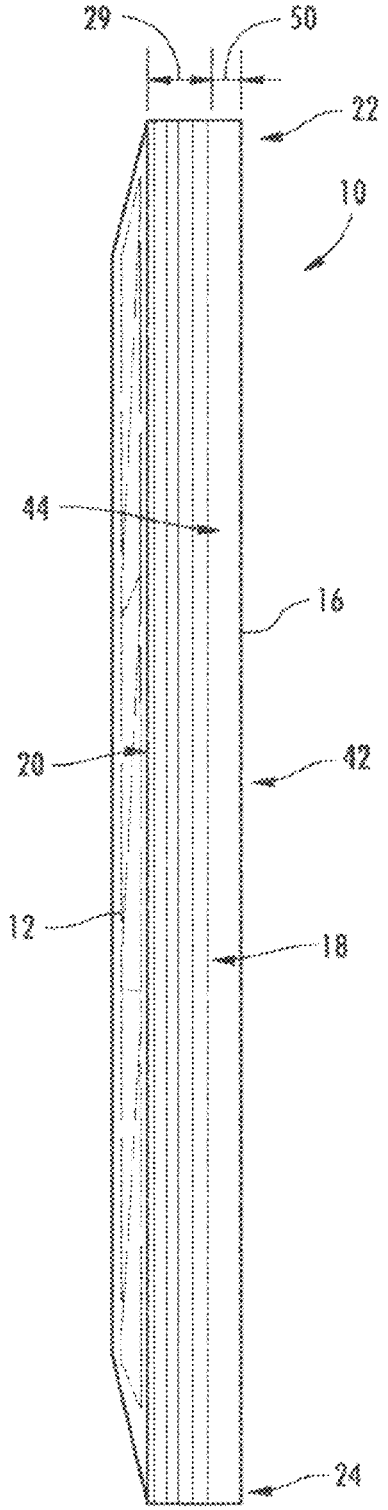
FIG. 1 is a side view of a die cut assembly according to an embodiment of the present invention.

The present invention will now be described with reference to the drawing figures in which like reference numerals refer to like parts throughout. For purposes of clarity in illustrating the characteristics of the present invention, proportional relationships of the elements have not necessarily been maintained in the drawings.

Referring now to FIG. 1, the die cut assembly 10 may preferably be used with a roller die cutting machine such as the one illustrated in U.S. Pat. No. 5,647,260 to cut sheet material into various predetermined shapes. As an alternative to a roller die cutting machine, the die cut assembly 10 may also be used in combination with any type of suitable press or other mechanism for applying force or compression to the die cut assembly 10. In general, the composition of the sheet material cut by the die cut assembly 10 may include but is not limited to: fabric, paper, cardboard, plastic and the like.

As shown in FIG. 1, the exemplary die cut assembly 10 may generally be rectangular and include a base member 12, a cutting rule 14, and a compressible top layer 16. The base member 12 as shown includes: a top face 18, a bottom face 20, a first end 22 and a second end 24 within a given thickness 29, Plywood or rigid plastic-like material may preferably be utilized for the base member 12. Alternatively, the base member 12 may be formed of any rigid or semirigid material known in the art. For example, an alternative embodiment of the base member 12 may include a sheet of clear material similar to Lexan®, Lucite® or Plexiglas so that an operator can visually position a graphic or pattern to be cut out by the die cut assembly 10.

The cutting rule 14 (shown in FIG. 2A) is preferably enclosed within the compressible top layer 16. The cutting rule 14 is preferably made of a high strength metal strip having a cutting edge (not shown) with the strength to perform shearing of fabric or paper. The cutting rule 14 preferably may have a width in the range of 1/64 to 3/32 inches thick. In addition, the cutting edge of the cutting rule 14 may preferably be beveled (i.e. a single or double beveled edge) to create a clean cut with little fraying. Preferably, the die cut assembly 10 may include any combination of cutting rule material and/or bevels.

According to a further preferred embodiment, the die cut assembly 10 may generally be sized for use in a roller die cutting machine (not shown). According to a preferred embodiment, the base member 12 may have: a length ranging from about 6 to 18 inches; a width ranging from about 4 to 12 inches; and a thickness ranging from ¼ inch to 1½ inches. Preferably, the cutting rule 14 should be positioned on the base member 12 so that a margin of at least ¼ inch extends between the cutting rule 14 and the edge of the based member 12 at all points. Preferably, this distance prevents biasing of the sheet material being cut.

FIG. 1 further illustrates a compressible top layer 16 that is generally rectangular, and which includes a top face 42 and a bottom face 44 within a given thickness 50. Preferably, the bottom face 44 of the compressible top layer 16 may be coupled to the top face 18 of the base member 12. According to a further preferred embodiment, the compressible top layer 16 is preferably an elastic or compressible material that subsequently returns to its original shape after being compressed. Elastic materials that may be utilized with the die assembly 10 may include but are not limited to: rubber, neoprene, compressible foam, sponge materials and the like. In general, the cutting rule 14 nests within the compressible top layer 16. Further, the thickness 50 of the compressible top layer 16 is preferably such that the top face 42 of the compressible top layer 16 extends beyond the cutting edge of cutting rule 14 in a direction away from the top face 18 of the base member 12. Preferably, this relative positioning allows for the cutting edge of the cutting rule 14 to be hidden and protected in an inactive position to protect users from contacting the cutting edge during handling and transport. When the compressible top layer 16 is compressed, the cutting edge is preferably exposed and comes into operable contact with sheet material. Preferably, the thickness 50 of the compressible top layer 16 is around ⅛-⅜ inches, but the person of ordinary skill in the art will recognize that alternative thicknesses may be required due to the sheet material being cut.

Figure 2A:
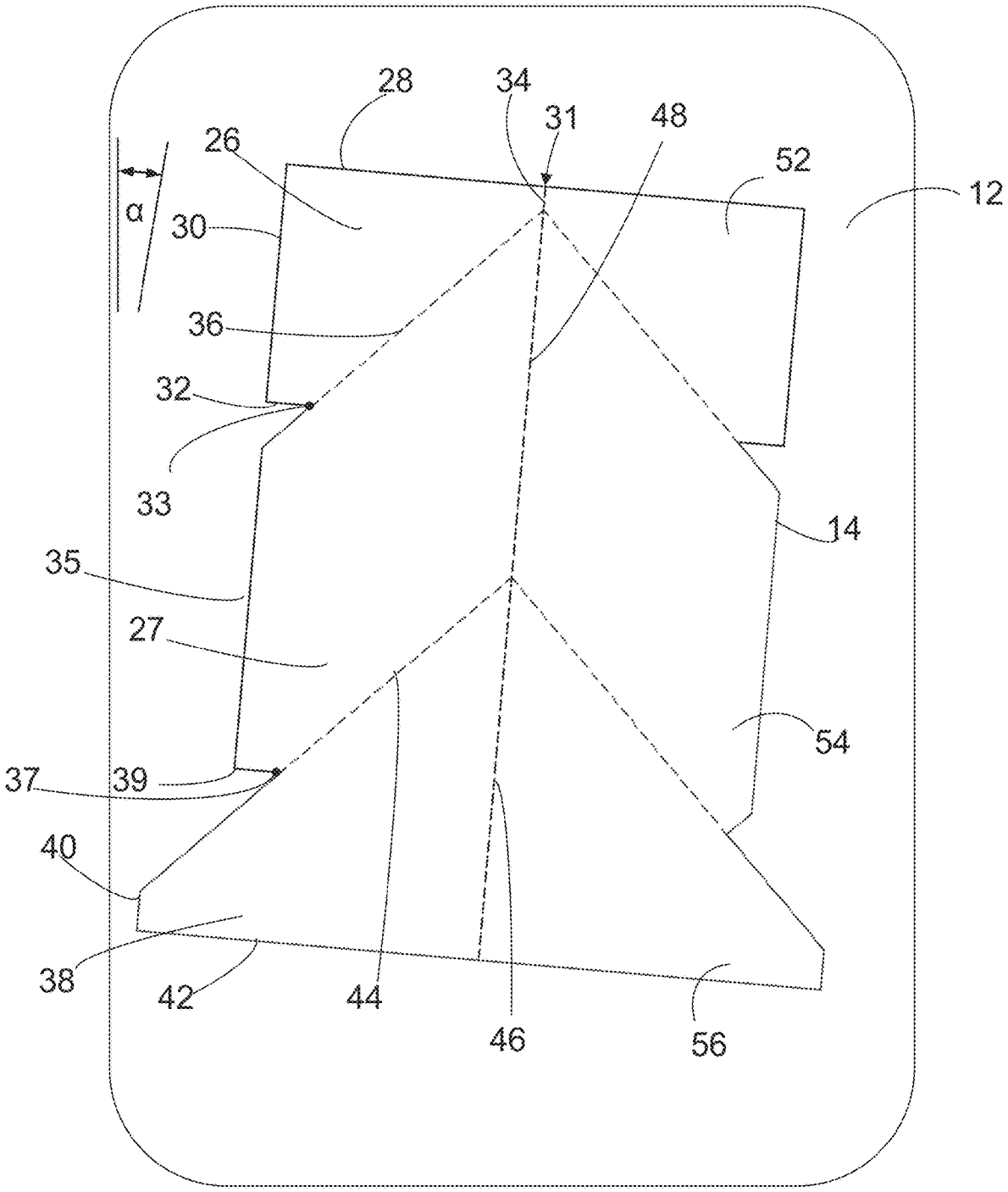
FIG. 2A is a top plan view of a die cut assembly according to an embodiment of the present invention.

Referring now to FIG. 2A, the cutting rule 14 is shown coupled to the base member 12 with the cutting rule 14 extending about ⅛ to ½ inch above from top face of base member 12. According to a preferred embodiment, the cutting rule 14 may preferably be formed into a pattern which includes: a first pentagon shape 26, a second pentagon shape 27, and a first quadrilateral shape 38 which are connected by shared edges. As shown, the first pentagon shape 26 preferably includes a first side 28, a second side 30 and a first hypotenuse 36. Preferably, the first pentagon shape 26 preferably further includes a first dog-eared side 32 which connects the hypotenuse 36 to the second side 30, As shown, the first dog-eared side 32 may intersect the first hypotenuse 36 at a first intersection point 33. Preferably, the first pentagon shape 26 preferably further includes a second dog-eared side 34 which connects the hypotenuse 36 to the first side 28.

According to a further preferred embodiment, the second pentagon shape 27 of the cutting rule 14 preferably is formed on a first side by the first hypotenuse 36 and on a second side by the second hypotenuse 44. Preferably, the second pentagon shape 27 may further include a left side edge 35, a dog-eared side 39, and a right side 48. As shown, the dog-eared side 39 may intersect the second hypotenuse 44 at a second intersection point 37.

Below the second pentagon shape 27, the first quadrilateral shape 38 preferably includes a first side 42, a second side 46 and a second hypotenuse 44. Preferably, the first quadrilateral shape 38 preferably further includes a first dog-eared side 40 which connects the second hypotenuse 44 to the first side 42.

As further shown in FIG. 2A, the first pentagon shape 26, the second pentagon shape 27, and the first quadrilateral shape 38 are preferably mirrored over a centerline 37 to produce a third pentagon shape 52, the fourth pentagon shape 54, and a second quadrilateral shape 56.

As further shown in FIG. 2A, the cutting rule 14 is preferably skewed or angled relative to the base member 12 such that no linear side included in the cutting rule is transverse to length of base member 12. As illustrated in FIG. 2A, the cutting rule 14 may be skewed with respect to base member 12 at an angle $\alpha$ which may be between about 1° and 45°, or alternatively between about 3° and 10°. The angle is generally shown in the figures, for exemplary purposes only, at about 5°.

Figure 2B:
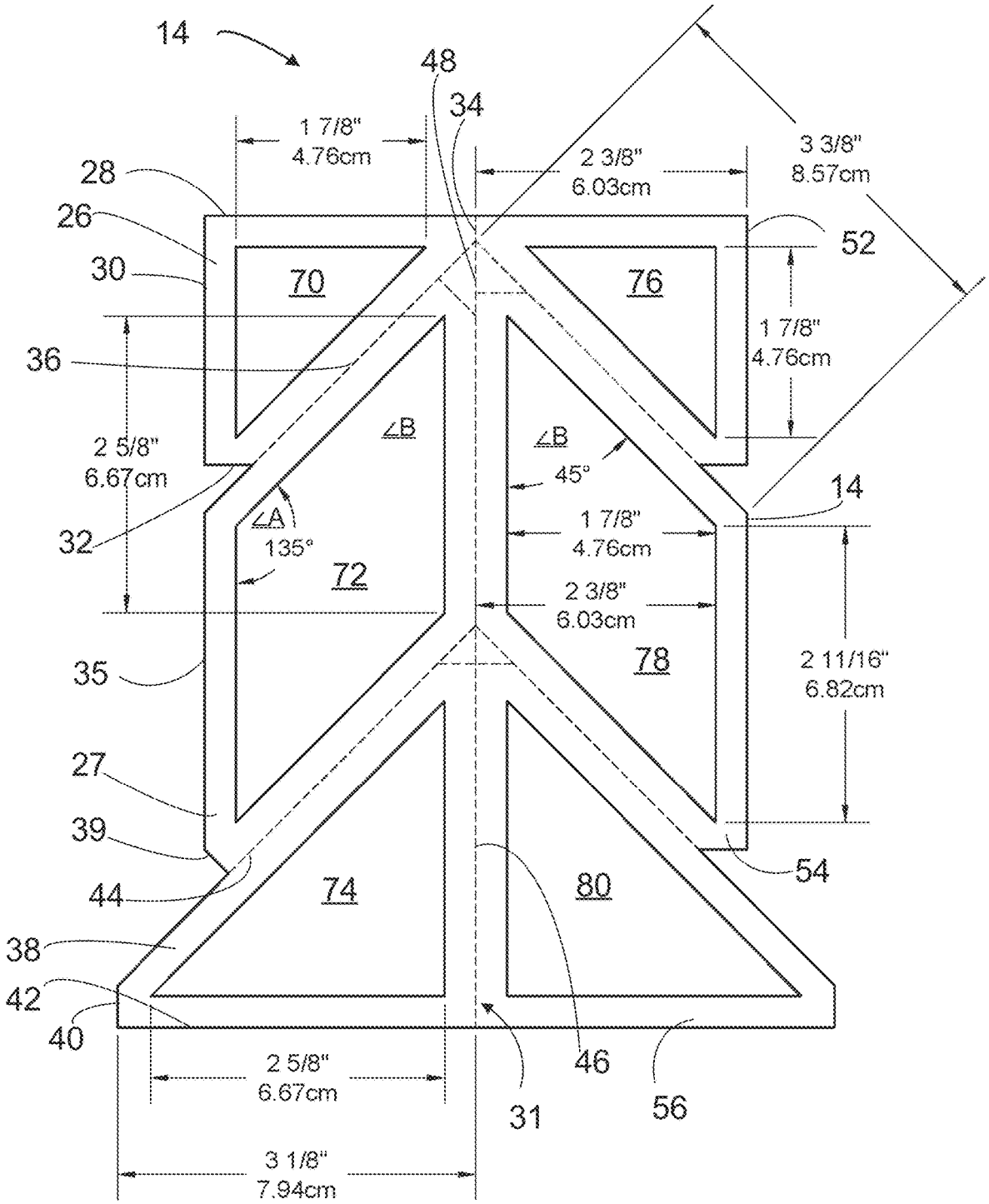
FIG. 2B is a top plan view of a die cut assembly according to an embodiment of the present invention with preferred, exemplary dimensions.

With reference now to FIG. 2B, a further view of the die cut assembly 14 (without the base member 12) is shown with preferred, exemplary dimensions provided. As shown in FIG. 2B and as discussed above, the cutting rule 14 may preferably be formed into a pattern which includes: a first pentagon shape 26, a second pentagon shape 27, and a first quadrilateral shape 38 which are connected by shared edges. As shown, the first pentagon shape 26 preferably includes a first side 28 which may preferably be within a range of 4.76 cm (1⅞") to 6.03 cm (2⅜") and a first hypotenuse 36 which may preferably be within a range of 6.73 cm (2.65") to 8.57 cm (3⅜"). As shown, the selected lengths of the first side 28, the second side 30 and the first hypotenuse 36 may preferably extend beyond the edges of a targeted enclosed shape or pattern 70. As shown in FIG. 2B, an exemplary enclosed shape or pattern within the first pentagon shape 26 may be an enclosed triangle 70 or the like. The same may be true for the third triangle shape 52 mirrored across the centerline/edge 37 which may enclose the dimensions of a triangle pattern 76 or the like.

Similarly, the second pentagon shape 27 may preferably include the hypotenuse 36 (as discussed above) and a first side 35 which may preferably have a length within a range of 6.67 cm (2⅝") to 8.57 cm (3⅜"). Further, the angle ∠A between the hypotenuse 36 and the first side 55 may be in the range of 110°-160°. According to a further preferred embodiment, the angle ∠A may preferably be approximately 135°. Further, the angle ∠B between the hypotenuse 36 and the centerline/edge 37 may be in the range of 30°-60°. According to a further preferred embodiment, the angle ∠B may preferably be approximately 45°. As shown, the selected lengths of the first side 35, and the hypotenuse 36 may preferably allow the second pentagon shape 27 to extend beyond the edges of a targeted enclosed shape or pattern 72. As shown in FIG. 2B, the exemplary pattern may be an enclosed parallelogram/diamond shape 72 or the like. The same may be true for the fourth pentagon shape 54 mirrored across the centerline/edge 37 which may enclose the dimensions of a parallelogram/diamond pattern 78 or the like.

As further shown in FIG. 2B, the first quadrilateral shape 38 may preferably include a first side 42, a second side 46 and a second hypotenuse 44. Preferably, the first side 42 may preferably have a length within a range of 6.67 cm (2⅝") to 7.94 cm (3⅛"). As shown, the selected lengths of the first side 42, the second side 46 and the second hypotenuse 44 may preferably allow the first quadrilateral shape 38 to extend beyond the edges of a targeted enclosed shape or pattern. As shown in FIG. 2B, the first quadrilateral shape 38 may be formed of dimensions to enclose a targeted triangular shape 74 or the like. The same may be true for the second quadrilateral shape 56 mirrored across the centerline 37 which may enclose the dimensions of a triangular shape 80 or the like.

Figure 3A:
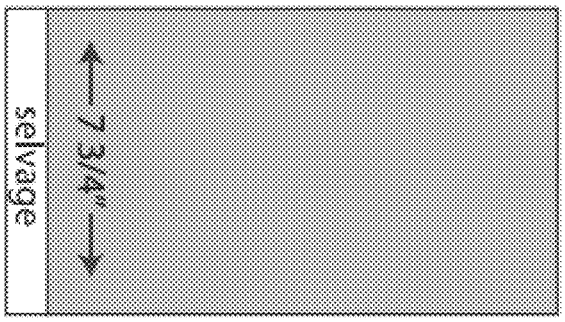
FIGS. 3A-3I illustrate exemplary steps for cutting materials in accordance with a preferred embodiment of the present invention.
Figure 3B:
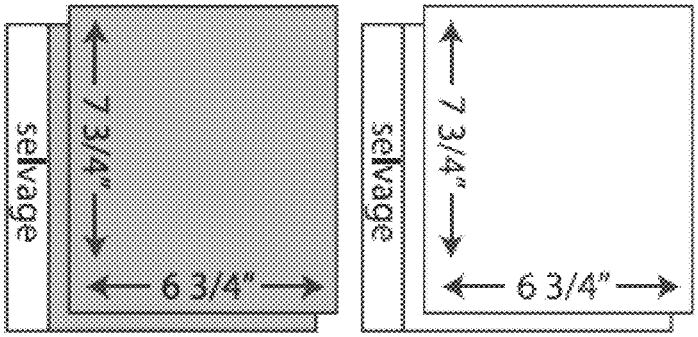
Figure 3C:
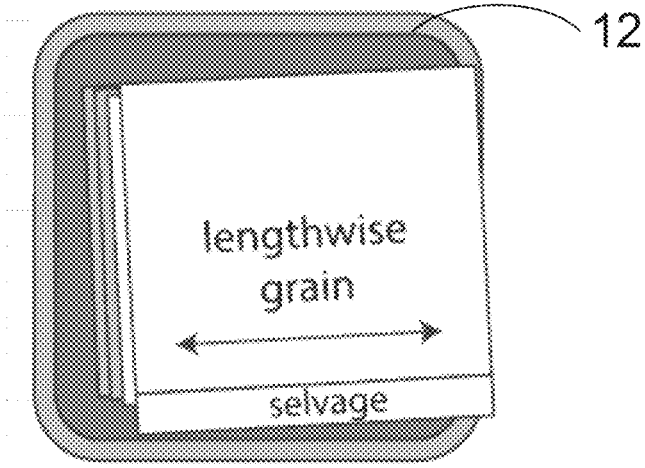
Figure 3D:
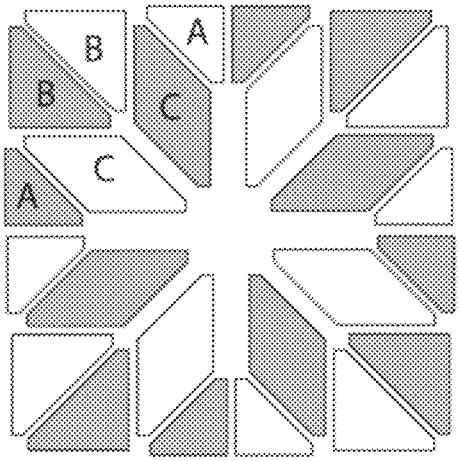

With reference now to FIGS. 3A-3I, a preferred, exemplary method for use of the cutting rule 14 above shall now be discussed. As first shown in FIG. 3A, it is preferred that two contrasting colors are chosen and that a fabric strip of each color is cut to equal widths. As shown, the fabric strips may be cut so that their widths are roughly 7¾". As shown in FIG. 3B, the fabric strips may then preferably be further cut to produce two rectangles of each color which may have dimensions of 7¾"×6¾". At a next step (FIG. 3C), the four rectangles are preferably then placed on the base member 12 above the cutting rule 14 (shown in FIG. 2A). Preferably, two layers of the first color fabric are placed together on the blades with the fabric facing right side up, and two layers of the second color fabric are placed with the fabric facing wrong side up. Still further, the fabric is preferably placed with the grain of each piece of fabric running lengthwise across the base member 12. As shown in FIG. 3D, the rectangles of fabric are then preferably fed through a roller die cutting machine (or pressing machine) and cut to produce groups of small dog-eared triangles A, larger dog-eared triangles B, and dog-eared parallelogram/diamond shapes C in each color of fabric. As discussed further below, the dog-eared triangles are alternatively referred to herein as pentagons or quadrilaterals depending on their number of sides. Similarly, the dog-eared parallelogram/diamond shapes are alternatively referred to herein as hexagons, pentagons or quadrilaterals depending on their number of sides.

Figure 3E:
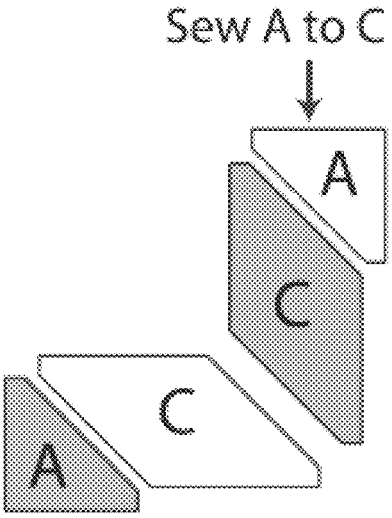
Figure 3F:
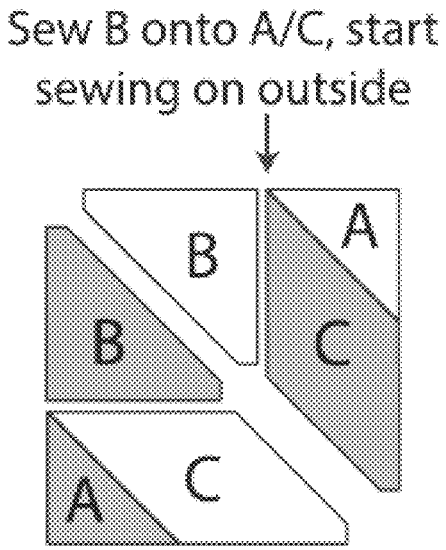
Figure 3G:
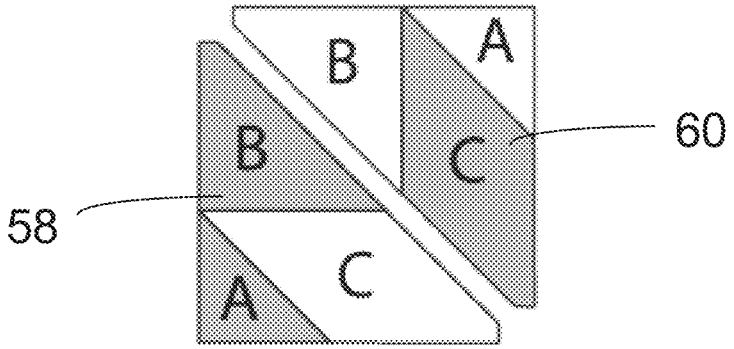
Figure 3H:
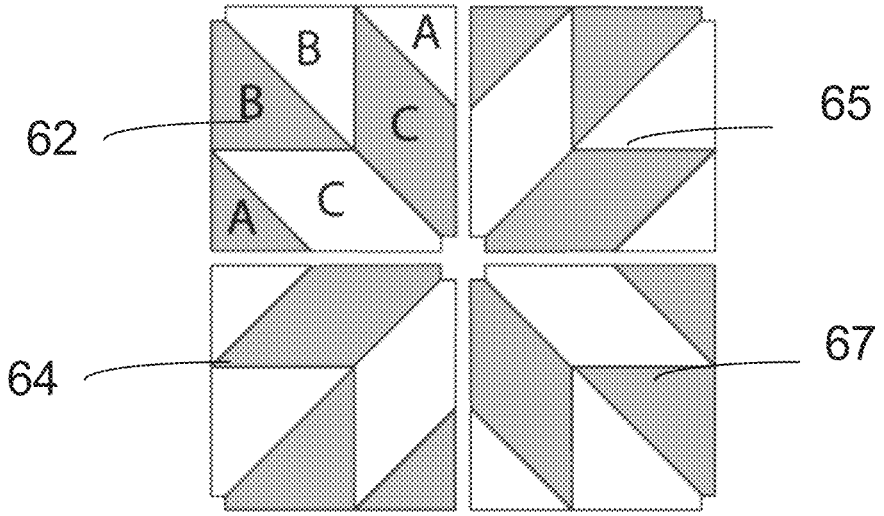
Figure 3I:
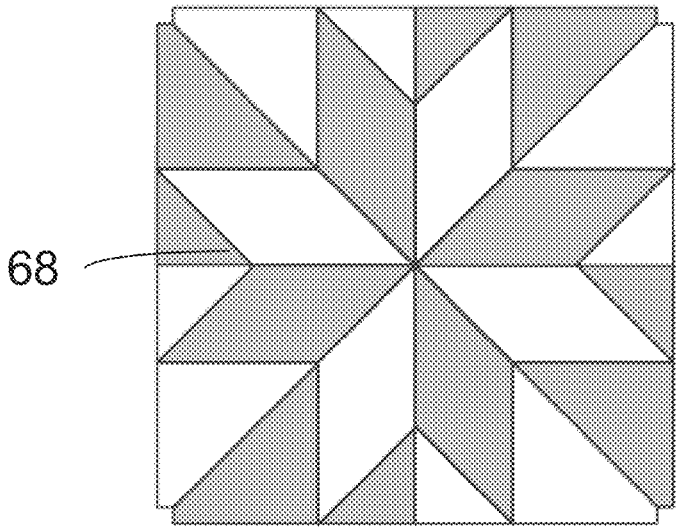

Following the cutting step, the individual shapes are then preferably sewn together as shown in FIGS. 3E-3H to produce a completed quilt as shown in FIG. 3I. Specifically, as shown in FIGS. 3E-3G, a small triangle A and a large triangle B of a first color are preferably sewn to adjacent sides of a parallelogram/diamond shape C of the opposite color to produce a pair of larger triangle shapes 58, 60 (units of A, B and C) with contrasting color patterns. According to a preferred embodiment, as shown in FIG. 3E, the small triangles A are preferably first sewn onto the matching sides of each parallelogram shape C by first matching the respective dog-eared corners of the small triangles A and parallelogram shapes C.

As shown in FIGS. 3G and 3F, the two larger triangle shapes 58, 60 are then preferably, sewn together to produce square quarter units 62, 64, 65, 67. As shown in FIG. 3I, the square quarter units 62, 64, 65, 67 are then preferably sewn together to make a single block 68 of contrasting color segments. According to a preferred embodiment, the single block 68 may preferably be 9"×9" but any other dimensions may be produced as well. According to further preferred embodiments, multiple blocks 68 may be produced and sewn together to create quilts of any desired size or dimension without limitation.

It should be noted that while terms such as top, bottom, left, and right are used in this specification and appended claims, such base terms are used to provide relative positions of the various components. Such positional terms should not be read as limiting the orientation of the diet cut in a three-dimensional space. For example, in some alternative embodiments, the die cut may be inverted such that the base member 12 is on top of the layer 16 when die cut assembly is in use.

While embodiments of the invention have been shown, it will be understood that the invention is not limited thereto, since modifications may be made by those skilled in the art, particularly considering the foregoing teachings. Reasonable variation and modification are possible within the scope of the foregoing disclosure of the invention without departing from the spirit of the invention. Further, while the above descriptions contain much specificity, these should not be construed as limitations on the scope, but rather as examples. Many other variations are possible. Accordingly, the scope of the present invention should be determined not by the embodiments illustrated, but by the appended claims and their legal equivalents.

What is claimed is:

1. A die cut assembly for use with a die cutting machine, wherein said die cutting assembly comprises:

a first base member including a top face, a bottom face, a top end, a bottom end, a left side, and a right side;

a cutting rule, wherein the cutting rule comprises a cutting edge coupled to said first base member; and a compressible layer, wherein the compressible layer comprises a first face and a second face; wherein said second face of said compressible layer is coupled to said top face of said base member;

wherein said cutting rule comprises at least a first cutting element, a second cutting element and a third cutting element;

wherein said first cutting element is comprised of a first edge, a second edge, a third edge, a fourth edge and a fifth edge; wherein said first and second edges are orthogonal to each other; wherein the third edge is the longest edge of the first cutting element; wherein the fourth cutting edge is connected between the first edge and the third edge; wherein the wherein fifth edge is connected between the third edge and the second edge; wherein the fourth edge is aligned orthogonally to the first edge and the fifth edge;

wherein said second cutting element is comprised of the third edge, a sixth edge, a seventh edge, an eighth edge, and a ninth edge; wherein said sixth and seventh edges are aligned orthogonally to the fourth edge; wherein the eighth cutting edge is connected between the seventh edge and the ninth edge;

wherein the third edge and the seventh edge form a first interior angle; wherein the first interior angle is within the range of 134°-136°;

wherein the third edge and the sixth edge form a second interior angle; wherein the second interior angle is within the range of 44°-46°;

wherein said third cutting element is comprised of the ninth edge, a tenth edge, an eleventh edge and a twelfth edge;

wherein the tenth edge and the eleventh edge are aligned orthogonally to each other; wherein the tenth edge is connected between the ninth edge and the eleventh edge;

wherein the third edge intersects with the fourth edge at a first intersection point; wherein the third edge extends beyond the first intersection point;

wherein the ninth edge intersects with the eighth edge at a second intersection point; wherein the ninth edge extends beyond the second intersection point;

wherein the first edge, fifth edge, sixth edge, seventh edge, tenth edge and twelfth edge are each oriented at an angle which is offset from the angle of the left side of the first base member; wherein the first cutting element comprises a first pentagon shape; wherein the second cutting element comprises a second pentagon shape; wherein the third cutting element comprises a quadrilateral shape; and further wherein the die cut assembly comprises a second set of cutting elements; wherein the second set of cutting elements comprise: a third pentagon shape; a fourth pentagon shape; and a second quadrilateral shape; wherein the first pentagon shape comprises a first side having a first length in the range of 4.76 cm to 6.03 cm; wherein the first pentagon shape comprises a second side having a second length in the range of 6.73 cm to 8.57 cm.; and wherein the first pentagon shape and the third pentagon shape share the fourth edge.

2. The die cut assembly of claim 1, wherein the first interior angle is 135°; wherein the second interior angle is 45°.

3. The die assembly of claim 1, wherein the third pentagon shape is congruent with the first pentagon shape.

4. The die cut assembly of claim 3, wherein the second pentagon shape and the fourth pentagon shape share the sixth edge.

5. The die cut assembly of claim 4, wherein the second pentagon shape and the fourth pentagon shape are congruent.

6. The die cut assembly of claim 5, wherein the first quadrilateral shape and the second quadrilateral shape share the twelfth edge.

7. The die cut assembly of claim 6, wherein the first quadrilateral shape and the second quadrilateral shape are congruent.

* * * * *